US009777741B2

(12) United States Patent
Marsis

(10) Patent No.: US 9,777,741 B2
(45) Date of Patent: Oct. 3, 2017

(54) NOZZLE-SHAPED SLOTS IN IMPELLER VANES

(71) Applicant: Baker Hughes Incorporated, Houston, TX (US)

(72) Inventor: Emanuel G. Marsis, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 317 days.

(21) Appl. No.: 14/548,603

(22) Filed: Nov. 20, 2014

(65) Prior Publication Data

US 2016/0146214 A1 May 26, 2016

(51) Int. Cl.
*F04D 29/22* (2006.01)
*F04D 13/10* (2006.01)
*F04D 31/00* (2006.01)

(52) U.S. Cl.
CPC ..... *F04D 29/2288* (2013.01); *F04D 13/10* (2013.01); *F04D 31/00* (2013.01)

(58) Field of Classification Search
CPC ..... F04D 29/2288; F04D 13/10; F04D 31/00; F04D 29/22; F04D 25/06; F04D 13/08; F04D 29/24; F04D 29/245; F04D 29/242; F04D 29/287; F04B 35/04
USPC ..... 415/1
See application file for complete search history.

(56) References Cited

U.S. PATENT DOCUMENTS 1,032,287 A * 7/1912 Kreher ..... F04D 29/2266 416/181
1,383,354 A * 7/1921 Wareing ..... F04D 29/2255 415/914
1,622,930 A * 3/1927 Von Karman ..... F01D 5/048 415/140
2,276,077 A * 3/1942 Oystein Jacobsen ..... F04D 29/2211 415/168.2
2,658,455 A * 11/1953 Seinfeld ..... F04D 29/2211 415/106
2,753,808 A * 7/1956 Kluge ..... F01D 5/145 416/183
3,058,415 A 5/1963 Culleton
3,775,024 A 11/1973 Ulm et al.
4,093,401 A * 6/1978 Gravelle ..... F04D 29/284 415/143

(Continued)

FOREIGN PATENT DOCUMENTS

GB 1456020 11/1976
JP 2003278685 A 10/2003
WO WO 2007/118525 A1 10/2007

*Primary Examiner* — Kenneth Bomberg
*Assistant Examiner* — Brian Delrue
(74) *Attorney, Agent, or Firm* — Bracewell LLP; James E. Bradley

(57) ABSTRACT

A well fluid centrifugal pump has a number of stages, each of the stages having an impeller and a diffuser. The impeller has vanes curving outward from a central intake area to a periphery of the impeller. Each of the vanes has a convex side and a concave side. An upstream slot and a downstream slot extend through the vane from the convex side to the concave side. Each of the slots has an entrance on the convex side and an exit on the concave side, with the entrance being located upstream from the exit. The entrance has a greater cross-sectional area than the exit to divert well fluid flowing along the convex side to the concave side to remove accumulated gas.

16 Claims, 3 Drawing Sheets

(56) References Cited

U.S. PATENT DOCUMENTS 4,278,399 A * 7/1981 Erickson ..... F04D 13/10 415/199.1
4,294,573 A * 10/1981 Erickson ..... E21B 43/124 415/121.2
4,778,341 A * 10/1988 Corradini ..... F04D 31/00 415/208.3
4,802,819 A * 2/1989 Bevington ..... F04D 29/628 415/199.3
4,865,519 A 9/1989 Diankui et al.
4,900,228 A * 2/1990 Yapp ..... F04D 29/30 416/183
5,257,910 A 11/1993 Hergt et al.
5,605,444 A * 2/1997 Paton ..... F04D 29/2277 416/183
5,628,616 A * 5/1997 Lee ..... F04D 29/2288 415/199.1
6,250,797 B1 6/2001 Weetman
6,406,277 B1 * 6/2002 Shafer ..... E21B 43/128 415/199.2
6,676,366 B2 * 1/2004 Kao ..... F04D 29/2288 415/1
6,752,590 B2 * 6/2004 Serio ..... F04D 29/2266 415/112
8,215,918 B2 * 7/2012 Hwang ..... F04D 29/281 416/231 B
9,046,090 B2 * 6/2015 Kao ..... F04B 35/04
9,140,271 B2 * 9/2015 Sugimoto ..... F04D 29/284
2005/0186065 A1 * 8/2005 Wilson ..... E21B 43/128 415/1
2009/0142207 A1 * 6/2009 Ring ..... F04B 47/06 417/410.1
2009/0195117 A1 * 8/2009 Parmeter ..... E21B 43/128 310/216.129
2010/0028136 A1 * 2/2010 Dorsch ..... F04D 29/2288 415/121.1
2012/0257998 A1 * 10/2012 Parmeter ..... F04B 53/18 417/423.13
2013/0195608 A1 * 8/2013 Gharaibah ..... B01D 45/14 415/1
2014/0105723 A1 * 4/2014 Porodo ..... F04D 29/444 415/1
2014/0178190 A1 * 6/2014 Gahlot ..... F04D 7/045 415/199.1

* cited by examiner

FIG. 4
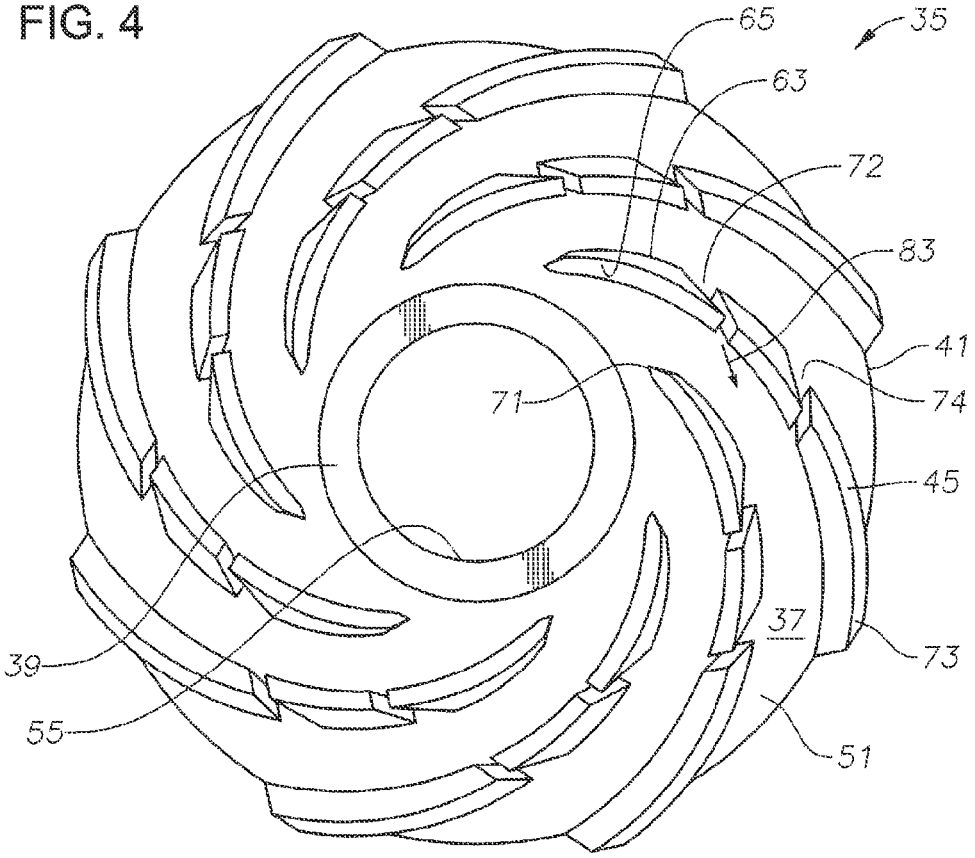
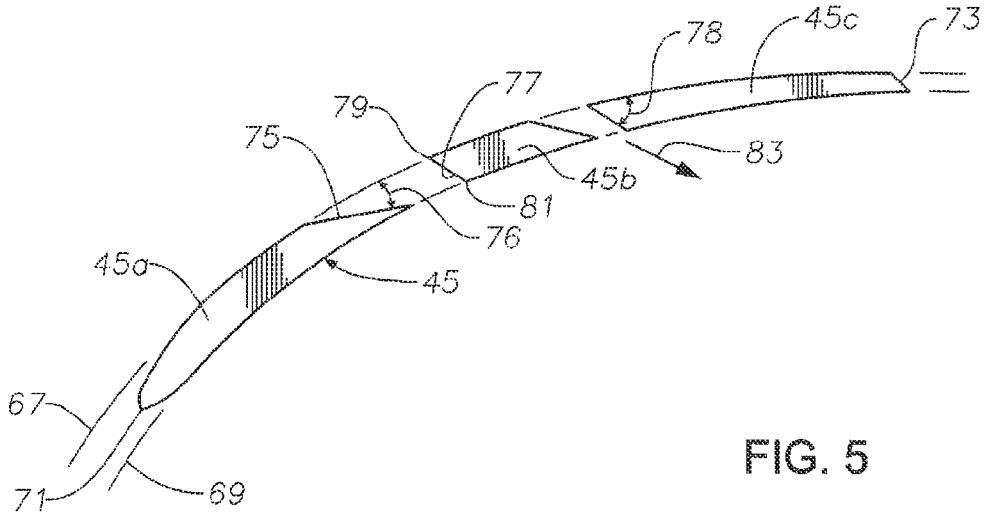
FIG. 5

NOZZLE-SHAPED SLOTS IN IMPELLER VANES

FIELD OF THE DISCLOSURE

This disclosure relates in general to centrifugal well fluid pumps and in particular to impellers having vanes with nozzle-shaped slots extending between the high and low pressure sides.

BACKGROUND OF THE DISCLOSURE

Electrical submersible pumps (ESP) are often employed to pump well fluid from wells. A typical ESP includes a rotary pump driven by an electrical motor. Normally, the ESP is suspended in the well on a string of production tubing. A seal section, usually located between the motor and the pump, has a movable element to reduce a pressure differential between the well fluid exterior of the motor and motor lubricant contained in the motor. The pump may be a centrifugal pump having a plurality of stages, each stage having an impeller and a diffuser.

Some wells produce gas along with liquid. Gas flowing into the pump can accumulate in pockets. The gas pockets can reach a size causing the pump to gas lock. When gas locked, the pump ceases to pump liquid. Unless remedial action is taken soon, the gas lock can cause excessive heat and damage to the ESP.

Gas separators of various types may be employed to separate the gas from the liquid prior to reaching the pump. However, some gas may still reach the pump, causing gas pockets to accumulate. Various designs to the impellers have been proposed to inhibit the formation of gas pockets. For example, U.S. Pat. No. 6,676,366 discloses split vanes having an inner vane member offset from an outer vane member.

SUMMARY

A well fluid pump assembly comprises a motor and a centrifugal pump. The pump has a plurality of stages, each of the stages comprising an impeller and a diffuser. The impeller has a plurality of vanes curving outward from a central intake area to a periphery of the impeller. Each of the vanes has a high pressure side and a low pressure side. The high pressure side of each of the vanes is located on a single curved high pressure line extending from the central intake area to the periphery of the impeller. The low pressure side of each of the vanes is located on a single curved low pressure line extending from the central intake area to the periphery of the impeller. At least one slot extends through the vane from the high pressure to the low pressure side to divert some of the fluid flowing along the high pressure side into the low pressure side.

Preferably, a flow area of the slot at the high pressure side is greater than a flow area of the slot at the low pressure side. A cross-sectional area of the slot gradually decreases from the high pressure side to the low pressure side. The slot has an entrance on the high pressure side and an exit on the lower pressure side, the entrance being located upstream from the exit.

In the preferred embodiment, the slot has an upstream wall and a downstream wall that are not parallel to each other. In one example, the upstream wall is located in an upstream wall plane and the downstream wall in a downstream wall plane. The upstream wall plane intersects the downstream wall plane at an acute angle. Also, in this embodiment, the upstream wall intersects the high pressure side at a greater angle than an intersection of the downstream wall with the high pressure side.

Upper and lower shrouds of the impeller join upper and lower edges, respectively, of the vanes, to define vane passages between adjacent ones of the vanes. Preferably, the slot in each of the vanes extends from the upper to the lower edge of the vane.

In the example shown, each vane has two slots, an upstream slot and a downstream slot spaced apart from each other along a length of the vane. In the embodiment shown, the upstream slot and the downstream slot have flow areas measured at the high pressure side that differ from each other.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

FIG. 4 is a perspective view of the impeller of the pump stage of FIG. 2, with the upper shroud not shown.

FIG. 5 is an enlarged view of an upper edge of one of the vanes of the impeller of FIG. 4.

DETAILED DESCRIPTION OF THE DISCLOSURE

Figure 1:
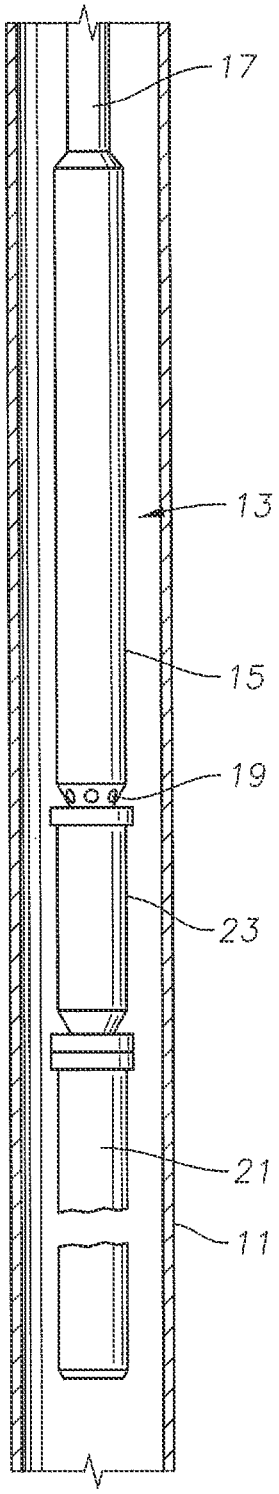
FIG. 1 is a side view of an electrical submersible pump assembly in accordance with this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, a cased well 11 extends downward from a wellhead (not shown). Cased well 11 contains an electrical submersible pump (ESP) 13 for pumping well fluid flowing into cased well 11. ESP 13 has a centrifugal pump 15 suspended on a string of production tubing 17. Pump 15 has a well fluid intake 19 and is driven by a motor 21, normally a three-phase electrical motor. A seal section 23 connects to motor 21 to reduce a pressure differential between a dielectric lubricant in motor 21 and the hydrostatic pressure of the well fluid. In this example, seal section 23 locates between motor 21 and pump intake 19, but it could be mounted to a lower end of motor 21. ESP 13 may also include other components, such as a gas separator (not shown) and another motor connected in tandem with motor 21. If a gas separator is employed, intake 19 would be at a lower end of the gas separator.

Although FIG. 1 shows ESP 13 oriented vertically, ESP 13 could be within an inclined or horizontal portion of cased well 11. The terms "upper", "lower" and the like are used only for convenience herein and not in a limiting manner because ESP 13 is not always operated vertically during operation.

Figure 2:
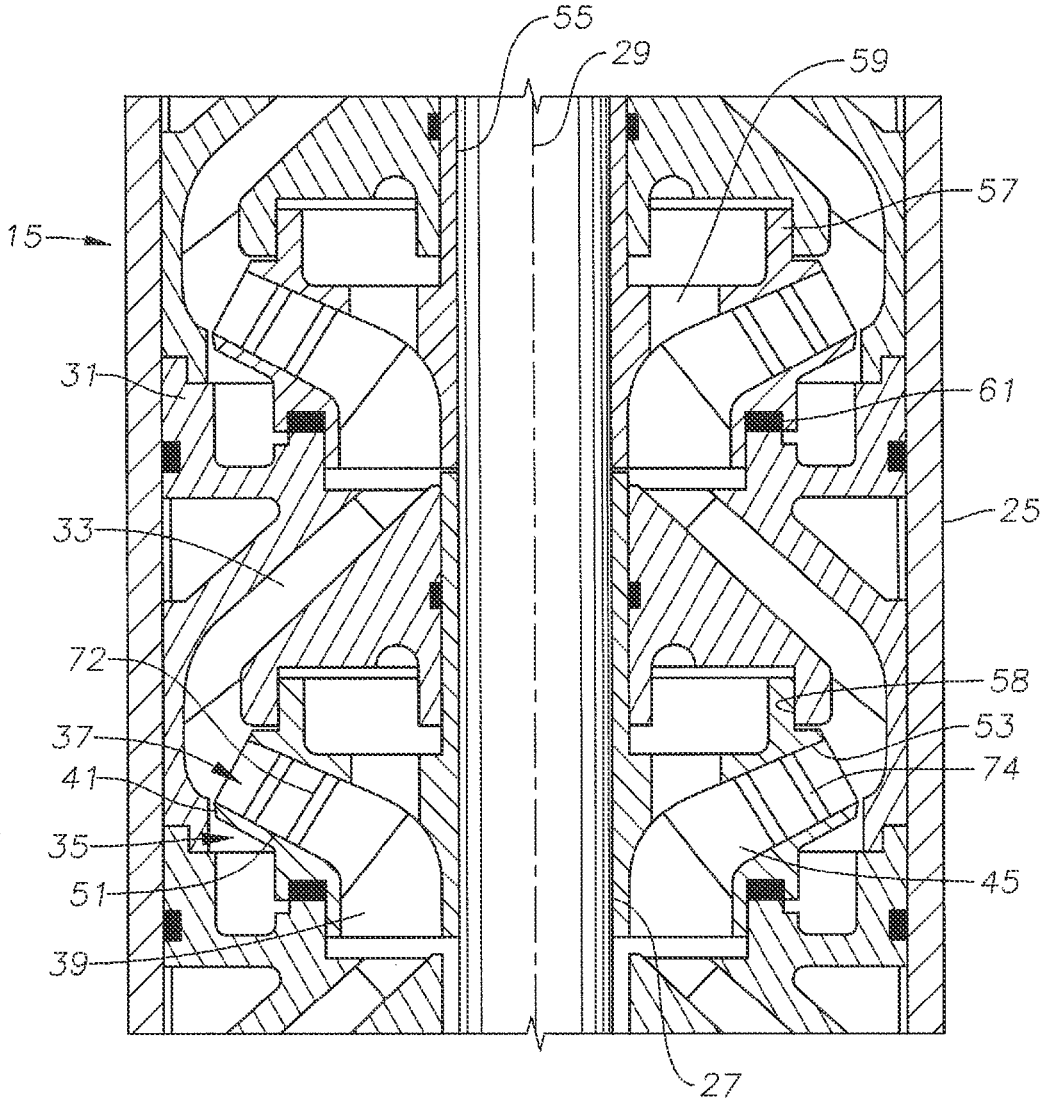
FIG. 2 is a sectional view of two stages of the pump of the pump assembly of FIG. 1.

Referring to FIG. 2, pump 15 has a cylindrical housing 25. A drive shaft 27 extends through housing 25 along a longitudinal axis 29. A plurality of diffusers 31 are stacked on top of each other within housing 25 and fixed against rotation relative to housing 25. Each diffuser 31 has a number of diffuser flow passages 33 that extend from a diffuser lower intake area upward and inward to a diffuser upper discharge area. Diffusers 31 may be conventional.

Each pump stage has an impeller 35 associated with each diffuser 31. Impeller 35 has a number of impeller flow passages 37 that extend upward and outward from an impeller intake area 39 to an impeller periphery 41. In the example shown, diffusers 31 and impellers 35 are shown as mixed flow types wherein impeller flow passages 37 extend upward and radially outward, and diffuser flow passages 33 extend upward and radially inward. However, more radial flow types of impellers and diffusers are feasible, wherein the flow passages do not extend upward as much.

Referring still to FIG. 2, each impeller flow passage 37 is defined on its sides by vanes 45. Impeller 35 has a lower cover or shroud 51 and an upper cover or shroud 53 spaced axially above. Shrouds 51 and 53 form the lower and uppers sides of each impeller flow passage 37. The upper side of lower shroud 51 joins the lower edges of vanes 45. The lower side of upper shroud 53 joins the upper edges of vanes 45. The upper and lower edges of vanes 45 may be integrally formed with upper shroud 53 and lower shroud 51 in a casting process.

Impellers 35 have hubs 55 that mount to shaft 27 for rotation in unison, such as by a key and keyway (not shown). Normally, each impeller 35 is free to float axially a limited amount relative to each other and to shaft 27. A balance ring 57 protrudes upward from each impeller 35 into sliding engagement with a diffuser cavity wall 58. Balance holes 59 may extend through upper shroud 53 from each impeller flow passage 37 to a cavity between upper shroud 53 and diffuser 31 within balance ring 57. A downthrust washer 61 locates between a lower annular surface of each impeller 35 and a mating surface on an upper end of the next lower diffuser 31.

Figure 3:
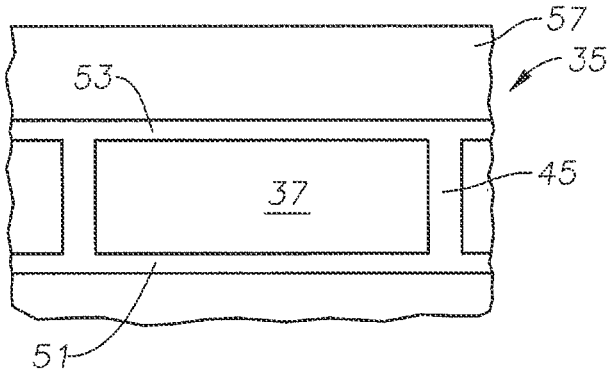
FIG. 3 is a side view of a portion of the impeller outlet.

As shown in FIG. 3, each impeller flow passage 37 has vanes 45 on opposite sides. The lower side of upper shroud 53 defines an upper side of each flow passage 37. The upper side of lower shroud 51 defines a lower side of each flow passage 37. The lower side of upper shroud 53 is generally parallel with the upper side of lower shroud 51 and orthogonal with the adjacent vanes 45 of each impeller flow passage 37. Normally, each flow passage 37 is generally rectangular when viewed in a transverse cross-section at any point along its length. The cross-sectional or flow area of each flow passage 37 increases gradually from impeller intake area 39 to impeller periphery 41 (FIG. 2) because adjacent vanes 45 diverge from each other from intake area 39 to periphery 41. The height of each flow passage 37, which is the distance from the lower side of upper shroud 53 to the upper side of lower shroud 51, is approximately constant throughout the length of each flow passage 37. Typically, the width of each flow passage 37 between adjacent vanes 45 is greater than the height.

FIG. 4 shows impeller 35 with upper shroud 53 removed. Vanes 45 spiral as they extend radially outward from intake area 39 to periphery 41. Each vane 45 has a high pressure or convex side 63 and a low pressure or concave side 65. High pressure side 63 will experience a higher fluid pressure than the pressure of fluid flowing along low pressure side 65. The term "convex" that describes high pressure side 63 refers to the curvilinear surface of vane 45 that faces into the direction of rotation, which would be counterclockwise when viewed as in FIG. 5. The curvilinear surface of vane 45 facing away from the direction of rotation may be referred to as the concave side 65.

FIG. 5 shows the upper edge of one of the vanes 45, the others being identical. A curved line referred to as a high pressure curved line 67 extends along high pressure side 63 continuously from a leading or upstream tip 71 to a trailing or downstream end 73. Leading tip 71 leads trailing end 73 considering the direction of rotation. Also, well fluid flows past leading tip 71 before reaching trailing end 73. Similarly, a curved line referred to as a low pressure curved line 69 extends along low pressure side 65 continuously from leading tip 71 to trailing end 73. In this example, the thickness of vane 45 decreases slightly from leading tip 71 to trailing end 73, thus the distance between high pressure curved line 67 and low pressure curved line 69 decreases from leading tip 71 to trailing end 73.

Preferably, each vane 45 has at least one slot extending through it. In this embodiment, each vane 45 has an upstream slot 72 and a downstream slot 74 extending through it. Upstream slot 72 and downstream slot 74 extend the entire height of each vane 45 from the lower side of upper shroud 53 (FIG. 3) to the upper side of lower shroud 51 (FIG. 3). In the preferred embodiment, upstream slot 72 and downstream slot 74 are generally rectangular in configuration. Upstream slot 72 is located closer to intake area 39 than downstream slot 74.

Upstream slot 72 and downstream slot 74 each extend completely through vane 45 from high pressure side 63 to low pressure side 65, resulting in an upstream vane portion 45*a*, an intermediate vane portion 45*b* and a downstream vane portion 45*c* if two slots 72, 74 are used. However fewer or more than two slots 72, 74 may be used. The high pressure sides 63 of vane portions 45*a*, 45*b* and 45*c* are located on the same, single high pressure curved line 67. The low pressure sides 65 of vane portions 45*a*, 45*b* and 45*c* are located on the same single low pressure curved line 69.

Each upstream and downstream slot 72, 74 has an upstream wall 75 and a downstream wall 77. Upstream wall 75 is closer to leading tip 71 than downstream wall 77. Upstream and downstream walls 75, 77 may be generally straight and flat, but are not parallel to each other in the preferred embodiment. Rather upstream wall 75 intersects high pressure side 63 at an angle 76 that is less than angle 78, which is the angle between downstream wall 77 and high pressure side 63. In other words, upstream wall 75 faces more into the direction of rotation than downstream wall 77. A plane containing upstream wall 75 intersects a plane containing downstream wall 77 at an acute angle.

The convergence of upstream wall 75 and downstream wall 77 toward each other at low pressure side 65 places them farther apart at a slot entrance 79 that a slot exit 81. Slot entrance 79 is on the high pressure side 63 and slot exit 81 is on the low pressure side 65. Slot entrance 79 is upstream or closer to leading tip 71 than slot exit 81. The cross-sectional flow area of upstream slot 72 and downstream slot 74 gradually decreases from entrance 79 to exit 81, defining a converging nozzle. Fluid is jetted through upstream slot 72 and downstream slot 74 along jets 83. Each jet 83 is oriented outward toward periphery 41 and away from the direction of rotation of impeller 35.

Downstream slot 74 is not identical in size or shape to upstream slot 72 in this embodiment. The width of entrance 79 of downstream slot 74 is less than the width of entrance 79 of upstream slot 72. Similarly, the width of exit 81 of downstream slot 74 is less than exit 81 of upstream slot 72. The flow area of downstream slot 74 at entrance 79 is less than the flow area of upstream slot 72 at entrance 79. The flow area of downstream slot at exit 81 is less than the flow are of upstream slot 72 at exit 81. Consequently, less well fluid will flow through downstream slot 74 than upstream slot 72.

The length of upstream vane portion 45*a* from upstream slot 72 to leading tip 71 may vary, and the length of intermediate vane portion 45*b* between upstream slot 72 and downstream slot 74 may vary. In this example, upstream slot 72 is about the same distance from leading tip 71 as downstream slot 74 is from trailing end 73, making upstream and downstream vane portions 45*a* and 45*c* about the same in length. In this example, the length of intermediate vane portion 45*b* between upstream slot 72 and downstream slot 74 is less than the lengths of upstream and downstream vane portions 45*a* and 45*c*.

During operation, motor 21 (FIG. 1) rotates shaft 27 (FIG. 2), causing impellers 35 to rotate relative to diffusers 31. Well fluid flows from impeller intake area 39 through impeller flow passages 37 and out the flow passages at periphery 41. If the well fluid contains gas that reaches pump 15, the gas will be present in the flowing well fluid. Gas can accumulate in each stage, creating pockets particularly in flow passages 37 along the low pressure sides 65 (FIGS. 3 and 4) of vanes 45. Normally, the well fluid flowing near high pressure sides 63 will contain less gas than the well fluid flowing near low pressure sides 65. The accumulation of gas in areas next to low pressure sides 65 can lead to damaging gas lock conditions. Upstream and downstream slots 72, 74 divert some of the well fluid flowing along the high pressure side 63 of each vane 45. The diversion creates jets 83 of high pressure fluid that discharge through slots 72, 74 into the adjacent flow passage 37 near the low pressure side of vane 45. If gas is present, jets 83 tend to push the gas out into the main flow stream of liquid and out impeller periphery 41.

Jets 83 reduce the accumulation of gas, reducing the tendency of pump 15 to gas lock. Removing the gas pockets allows pump 15 to have a higher pumping head, or discharge pressure, compared to stages lacking nozzle-shaped slots.

While the disclosure has been shown in only one of its forms, it should be apparent to those skilled in the art that it is susceptible to various modifications.

The invention claimed is:

1. A well fluid pump assembly, comprising:

a motor;

a centrifugal pump operatively coupled to and driven by the motor, the pump having a plurality of stages, each of the stages comprising an impeller and a diffuser, the impeller comprising:

a plurality of vanes curving outward from a central intake area to a periphery of the impeller, each of the vanes having a high pressure side and a low pressure side;

the high pressure side of each of the vanes being located on a single curved high pressure line extending from the central intake area to the periphery of the impeller;

the low pressure side of each of the vanes being located on a single curved low pressure line extending from the central intake area to the periphery of the impeller;

an upstream slot and a downstream slot extending through each of the vanes from the high pressure to the low pressure side to divert some of the fluid flowing along the high pressure side into the low pressure side; wherein a flow area of each of the upstream slot and the downstream slot of each of the vanes is fixed and greater at the high pressure side than at the low pressure side; and the flow area of the upstream slot at the low pressure side of each of the vanes is greater than the flow area each of the downstream slot at the low pressure side.

2. The assembly according to claim 1, wherein a distance along the high pressure side from an upstream tip to the upstream slot of each of the vanes is greater than a distance along the high pressure side from the upstream slot to the downstream slot of each of the vanes.

3. The assembly according to claim 1, wherein the flow area of the upstream slot and the flow area of the downstream slot in each of the vanes gradually decrease from the high pressure side to the low pressure side.

4. The assembly according to claim 1, wherein in each of the vanes, each of the slots has an upstream wall and a downstream wall that are non parallel to each other, and wherein the upstream wall of the downstream slot in each of the vanes is at a greater angle relative to the high pressure side than the upstream wall of the upstream slot.

5. The assembly according to claim 1, wherein in each of the vanes, each of the slots has an upstream wall that is located in an upstream wall plane and a downstream wall spaced downstream from the upstream wall and located in a downstream wall plane that intersects the upstream wall plane at an acute angle.

6. The assembly according to claim 1, wherein:

in each of the vanes, each of the slots has an upstream wall and a downstream wall that is located downstream from the upstream wall; wherein the downstream wall of the upstream slot and the downstream slot in each of the vanes intersects the high pressure side at a greater angle than an intersection of the upstream wall with the high pressure side; and the angle that the upstream wall of the downstream slot in each of the vanes intersects the high pressure side is greater angle than the angle that the upstream wall of the upstream slot intersects the high pressure side.

7. The assembly according to claim 1, wherein in each of the vanes, each of the slots has an entrance on the high pressure side and an exit on the lower pressure side, the entrance being located upstream from the exit.

8. The assembly according to claim 1, wherein the impeller further comprises:

upper and lower shrouds joining upper and lower edges, respectively of the vanes, to define vane passages between adjacent ones of the vanes; and wherein each of the vanes, each of the slots extends from the upper to the lower edge of the vane.

9. The assembly according to claim 1, wherein: in each of the vanes, a distance along the high pressure side from a downstream tip of the vane to the downstream slot is no greater than a distance from an upstream tip of the vane to the upstream slot.

10. The assembly according to claim 1, wherein the flow area of the upstream slot in each of the vanes at the high pressure side is greater than the flow area of the downstream slot at the high pressure side.

11. A well fluid pump assembly, comprising:

a motor;

a centrifugal pump operatively coupled to and driven by the motor, the pump having a plurality of stages, each of the stages comprising an impeller and a diffuser, the impeller comprising:

a plurality of vanes curving outward from a central intake area to a periphery of the impeller, each of the vanes having a convex side and a concave side and comprising:

an upstream slot and a downstream slot extending through the vane from the convex side to the concave side, the upstream slot being farther distance to an upstream tip of the vane than a distance from the upstream slot to the downstream slot;

each of the slots having an entrance on the convex side and an exit on the concave side, the entrance being located upstream from the exit;

wherein the entrance of each of the slots has a greater cross-sectional area than the exit of the same slot to divert well fluid flowing along the convex side to the concave side;

the cross-sectional areas of the entrance and the exit of each of the slots are fixed; and wherein each of the upstream and downstream slots has an upstream wall and a downstream wall that are not parallel to each other, and wherein the upstream wall of the downstream slot is at a greater angle relative to the convex side than the upstream wall of the upstream slot.

12. The assembly according to claim 11, wherein the flow area of each of the upstream and downstream slots gradually decreases from the entrance to the exit, and the flow area at the exit of the upstream slot is greater than the flow area at the exit of the downstream slot.

13. A well fluid pump assembly, comprising:

a motor a centrifugal pump operatively coupled to and driven by the motor, the pump having a plurality of stages, each of the stages comprising an impeller and a diffuser, the impeller comprising:

a plurality of vanes curving outward from a central intake area to a periphery of the impeller, each of the vanes having a convex side and a concave side and comprising:

an upstream slot and a downstream slot extending through the vane from the convex side to the concave side, the upstream slot being a farther distance to an upstream tip of the vane than a distance from the upstream slot to the downstream slot;

each of the slots having an entrance on the convex side and an exit on the concave side, the entrance being located upstream from the exit:

wherein the entrance of each of the slots has a greater cross-sectional area than the exit of the same slot to divert well fluid flowing along the convex side to the concave side: the cross-sectional areas of the entrance and the exit of each of the slots are fixed: and wherein each of the upstream and downstream slots has an upstream wall that is located in an upstream wall plane and a downstream wall spaced downstream from the upstream wall and located in a downstream wall plane that intersects the upstream wall plane at an acute angle.

14. The assembly according to claim 13, wherein:

each of the upstream and downstream slots has an upstream wall and a downstream wall that is located downstream from the upstream wall; and wherein the upstream wall intersects the convex side at a lesser angle than an intersection of the downstream wall with the convex side.

15. The assembly according to claim 11, wherein the impeller further comprises:

upper and lower shrouds joining upper and lower edges, respectively of the vanes, to define vane flow passages between adjacent ones of the vanes; and wherein each of the upstream and the downstream slots in each of the vanes extends from the upper to the lower edge of the vane.

16. The assembly according to claim 13, wherein:

the upstream slot in each of the vanes has a greater flow area measured at the convex side than a flow area of the downstream slot, measured at the convex side.

* * * * *